US007445481B2

(12) United States Patent
Nagashima et al.

(10) Patent No.: US 7,445,481 B2
(45) Date of Patent: Nov. 4, 2008

(54) CONNECTOR

(75) Inventors: Shinyu Nagashima, Yokkaichi (JP); Akihito Maegawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 24 days.

(21) Appl. No.: 11/602,057

(22) Filed: Nov. 20, 2006

(65) Prior Publication Data

US 2007/0117440 A1 May 24, 2007

(30) Foreign Application Priority Data

Nov. 24, 2005 (JP) ..... 2005-338861

(51) Int. Cl.
*H01R 13/52* (2006.01)

(52) U.S. Cl. ..... 439/276; 439/936

(58) Field of Classification Search ..... 439/276, 439/936

See application file for complete search history.

(56) References Cited

U.S. PATENT DOCUMENTS

| | | | | |
|---|---|---|---|---|
| 3,721,948 | A * | 3/1973 | Brandt et al. | 439/695 |
| 4,729,743 | A | 3/1988 | Farrar et al. | |
| 5,266,054 | A | 11/1993 | Duncan et al. | |
| 6,059,594 | A * | 5/2000 | Davis et al. | 439/275 |
| 6,149,456 | A | 11/2000 | Uchiyama | |
| 6,193,536 | B1 * | 2/2001 | Sanuki | 439/271 |
| 2002/0102874 | A1 | 8/2002 | Hobson et al. | |

FOREIGN PATENT DOCUMENTS

| | | |
|---|---|---|
| DE | 41 01 338 A1 | 7/1991 |
| DE | 41 01 388 A1 | 7/1991 |
| DE | 296 22 860 U1 | 7/1997 |
| DE | 198 48 732 A1 | 4/2000 |
| JP | 08-250193 | 9/1996 |

* cited by examiner

*Primary Examiner*—Tho D. Ta
*Assistant Examiner*—Travis Chambers
(74) *Attorney, Agent, or Firm*—Gerald E. Hespos; Anthony J. Casella

(57) ABSTRACT

A filling recess (25) for a sealant "s" is formed in a bottom of a fitting recess (22) and a boundary stepped surface (30) is formed around the filling recess (25) to define an annular area between the filling recess (25) and the outer peripheral edge of the boundary stepped surface (30). A detecting stepped surface (34) is formed around the upper edge of the filling recess (25) and is slightly lower than the boundary stepped surface (30). A filled amount of the sealant "s" is proper if the detecting stepped surface (34) cannot be seen, but the boundary stepped surface (30) can be seen. The filled amount is too little if both stepped surfaces (34, 30) can be seen, and it is excessive if neither of the stepped surfaces (34, 30) can be seen.

10 Claims, 6 Drawing Sheets

CONNECTOR

BACKGROUND OF THE INVENTION

1. Field of the Invention

The invention relates to a connector filled with sealant and to a molding method therefor.

2. Description of the Related Art

Japanese Unexamined Patent Publication No. H08-250193 discloses an intermediate connector with a body made of a synthetic resin and having opposite front and rear ends. A fitting recess is formed at the front of the body and is configured to receive a mating connector. Tab-shaped terminal fittings are embedded by insert molding while ends of the tab-shaped terminals project from the bottom surface of the fitting recess. The terminal fittings and the body may not be held in close contact due to poor affinity between the terminal fittings and the resin of the main body. Therefore, a sealant, such as epoxy resin, must be filled on the bottom of the fitting recess to ensure sealing.

A filled amount of the sealant must be administered in the above-described connector. The height of the sealant may be too high if an excessive amount of the sealant is filled. As a result, the connector may not connect properly with the mating connector. However, sealing may be impaired if the filled amount is reduced to avoid this problem.

Accordingly, a mark, such as a groove, conventionally has been provided on a surrounding wall of the fitting recess to enable the filled height of the sealant to be confirmed by eye. However, the filled part of the sealant is at the bottom surface of the fitting recess. Therefore, it has been difficult to judge whether the filled sealant is at a suitable height.

The invention was developed in view of the above problem and an object thereof is enable a filled amount of sealant to be precisely judged particularly by eye.

SUMMARY OF THE INVENTION

The invention is a connector with a main body made of synthetic resin and formed with a fitting recess for receiving a mating connector. Terminal fittings project from a bottom surface of the fitting recess. A sealant is filled substantially around base ends of the projecting terminal fittings. The bottom surface of the fitting recess is recessed in at least part of an area surrounding the projections of the terminal fittings to form a filling recess for the sealant. A diverging boundary surface is formed around at least part of the filling recess at a height corresponding to an upper limit of the sealant. A visual confirmation area is defined by forming the fitting recess and the diverging boundary surface so that a width between the outer peripheral edges of the fitting recess and the boundary surface is larger in a partial lengthwise area along peripheral direction than in the remaining lengthwise area. A detecting surface is formed around the outer periphery of the filling recess. The detecting surface is slightly lower than the boundary surface and has a width of between about one third and about two thirds of the width set to about half the width, between the peripheral edge of the fitting recess and that of the diverging boundary surface in at least part of the visual confirmation area.

A filled amount of the sealant is proper when the sealant is at a height to cover only the detecting stepped surface. More particularly, the filled amount of the sealant is proper if the sealant covers the detecting stepped surface, but does not cover the boundary stepped surface at the outer side of the detecting stepped surface. Both the detecting stepped surface and the boundary stepped surface can be seen if the filled amount is too little, whereas both the detecting stepped surface and the boundary stepped surface are covered by the sealant if the filled amount is excessive.

Both the diverging detecting surface and the diverging boundary surface are wide in the visual confirmation area. Thus, the three states can be judged precisely by eye, and an observer can judge visually whether the filled amount of the sealant is proper. Further, the wide visual confirmation area is provided by varying the shape and position of the filling recess. Thus, the entire connector need not be enlarged.

The visual confirmation area preferably is formed by causing the substantially planar shapes of the filling recess and the diverging boundary surface to differ from each other.

The visual confirmation area preferably is formed by locating the filling recess at an eccentric position so that the center of the fitting recess is deviated from the center of the diverging boundary surface.

The terminal fittings preferably project up from the bottom surface of the fitting recess, and projecting portions are formed at positions of the bottom surface where the terminal fittings project.

Bite-in grooves preferably are formed in the substantially opposite surfaces of the respective terminal fittings.

Intermediate parts of the terminal fittings preferably are embedded by insert molding in at least one primary molded piece by insert molding. Secondary insert molding is applied to form at least one secondary molded piece with the primary molded pieces, including the terminal fittings, as an insert to form the connector main body.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 2:
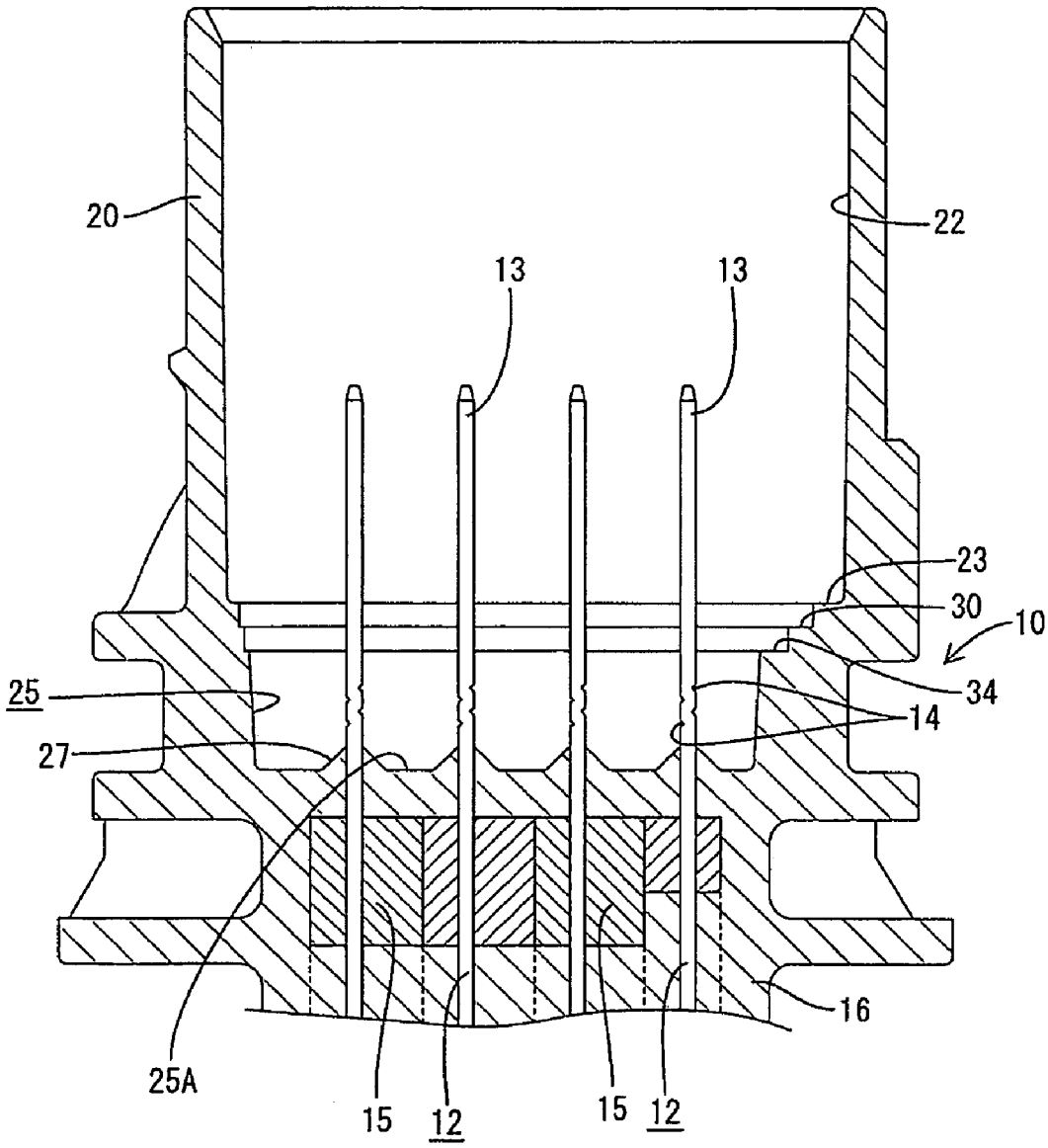
FIG. 2 is a vertical section of the connector of FIG. 1.
Figure 3:
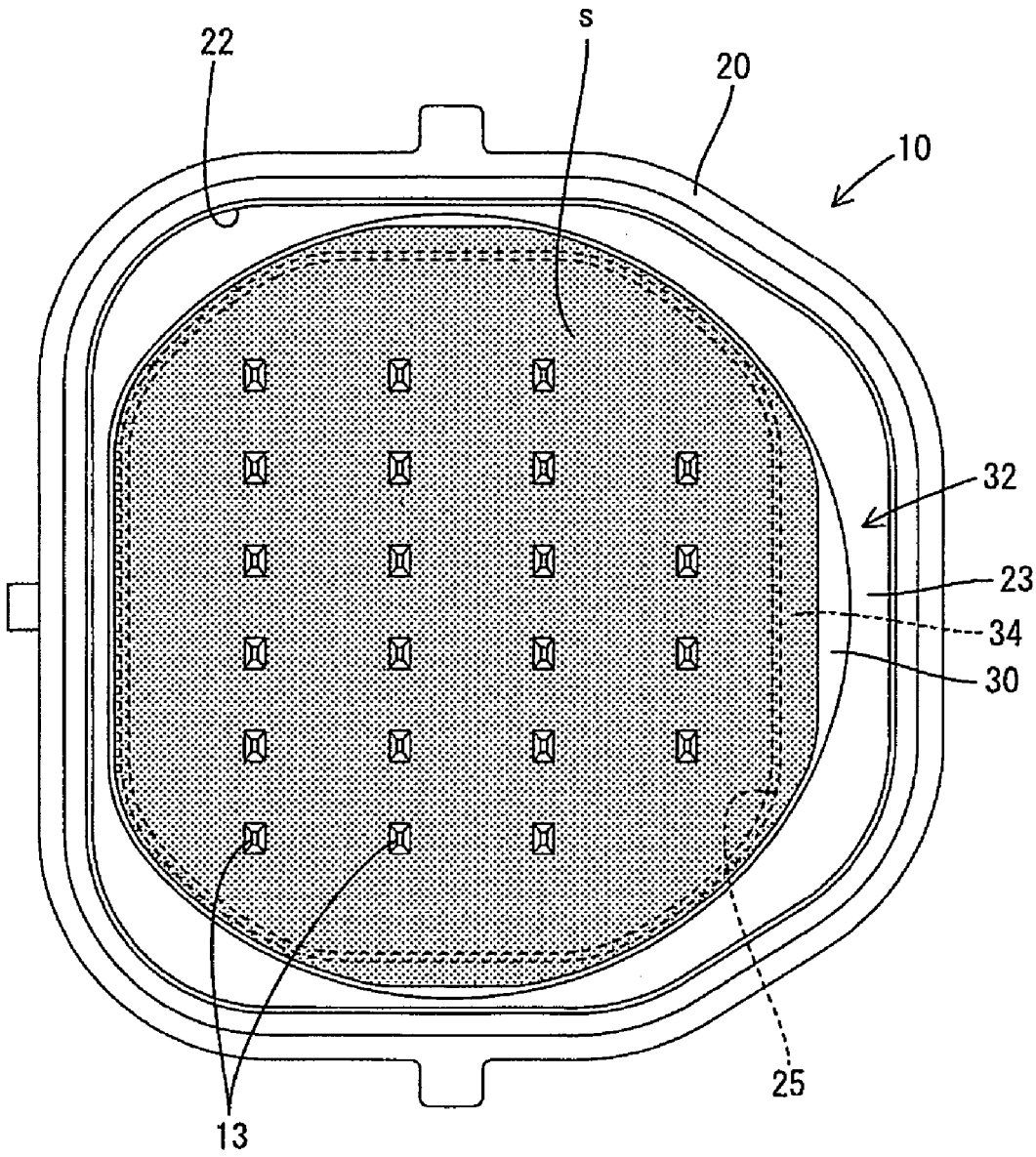
FIG. 3 is a plan view of the connector when a proper amount of sealant is filled.
Figure 4:
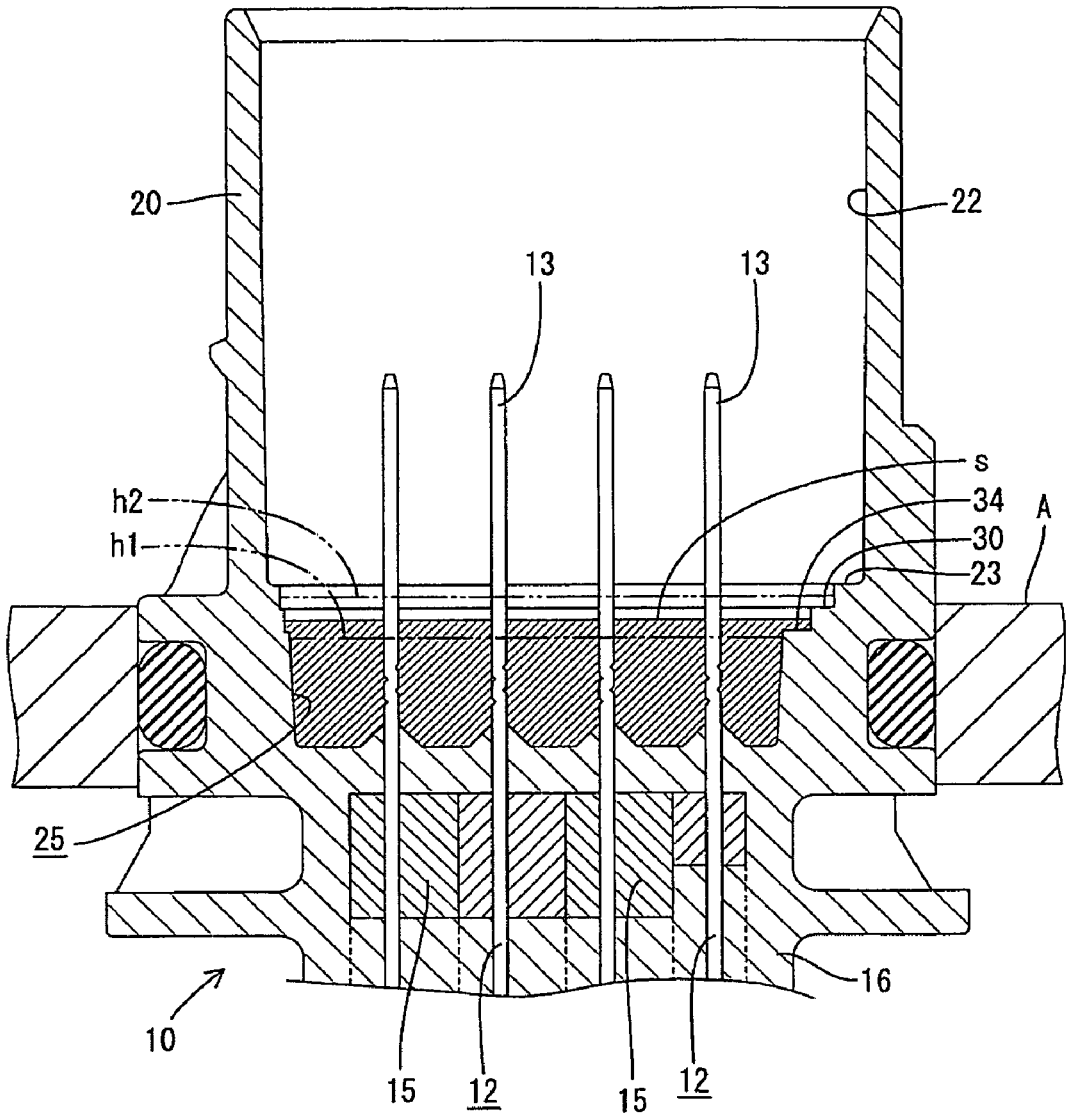
FIG. 4 is a vertical section of the connector of FIG. 3.

An intermediate connector for a transmission case is illustrated in FIGS. 1-6, as an example of the invention. This connector has connecting portions for mating connectors at two opposite ends and is mounted through a top plate A of the transmission case for electrical connection between devices inside and outside the transmission casing, as shown in FIG. 4. The construction of the connecting portion at the outer side where sealant is filled, i.e. so-called potting is applied, is described below.

Figure 1:
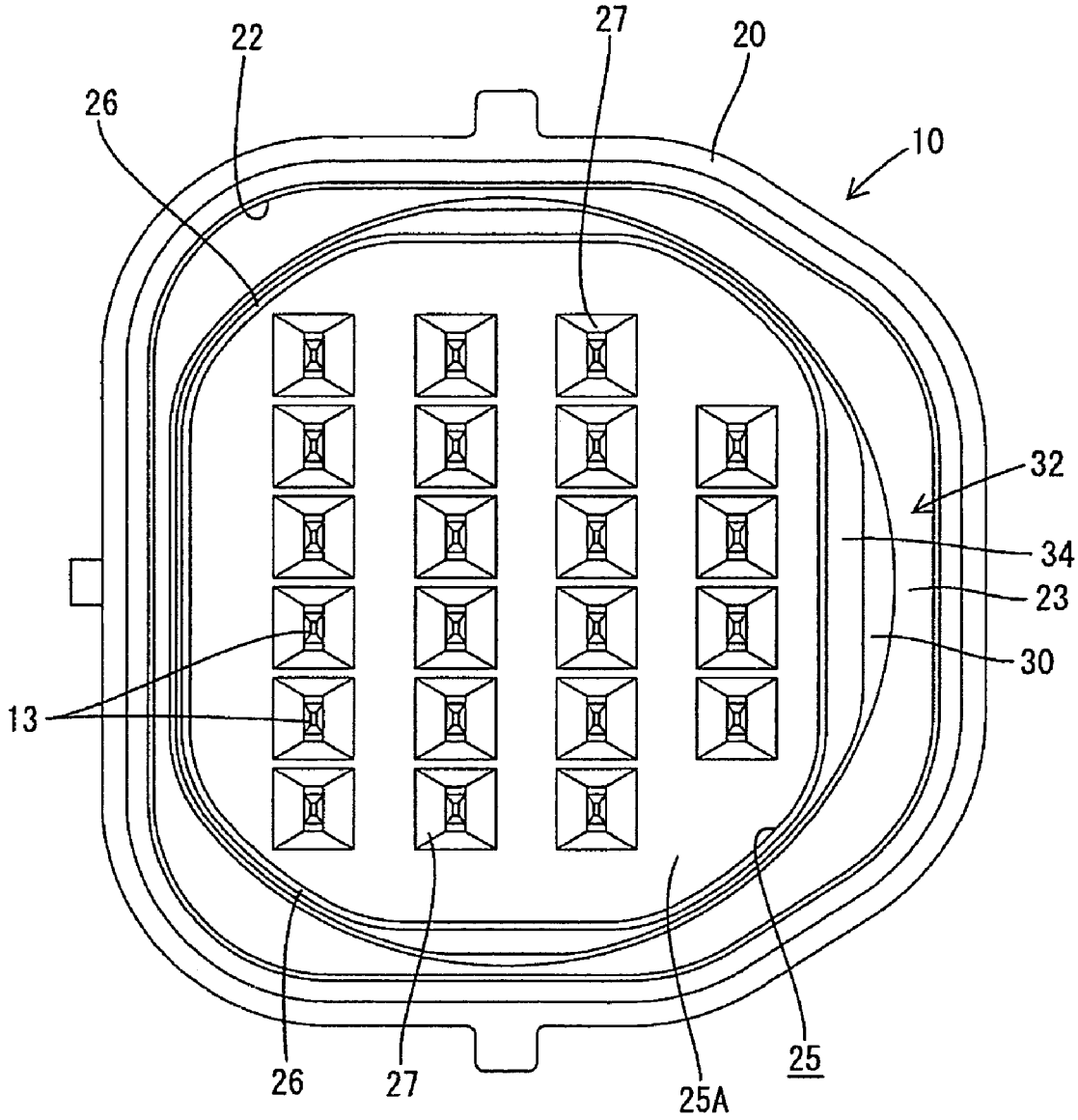
FIG. 1 is a plan view of a connector according to the invention.

A main body of the connector is identified by 10 in FIGS. 1 and 2 and is made e.g. of synthetic resin, such as Nylon 66, 33% glass filled. A receptacle 20 is formed at an upper end of the main body 10 and defines the connecting portion at the outer side. A fitting recess 22 is formed in the main body 10 for receiving an unillustrated mating female connector. Male terminals 12 are embedded in the main body 10 and are substantially aligned in the transverse and/or longitudinal directions. Tabs 13 at ends of the male terminals 12 project out and up from a bottom surface 23 of the fitting recess 22. More specifically, male terminals 12 are embedded in each primary molded piece 15 by insert molding and penetrate the primary molded piece 15. Secondary insert molding is applied to form a secondary molded piece 16 with the primary molded pieces 15 including the male terminals 12 as an insert to form the main body 10.

The receptacle 20 is a substantially rectangular tube with opposite corners at right side in FIG. 1 obliquely beveled. Accordingly, the bottom surface 23 of the fitting recess 22 substantially has a substantially planar rectangular shape with opposite right corners beveled obliquely. The male terminals 12 project in an area of the bottom surface 23 of the fitting recess 22 slightly laterally displaced towards the left in FIG. 1.

A filling recess 25 of specified depth is formed in the bottom surface 23 of the fitting recess 22. Thus, a sealant "s" can at least partly fill the filling recess 25 to at least partly surround the projecting positions of the male terminals 12. The sealant "s" is an epoxy resin or the like and preferably has a color different from the main body 10. The filling recess 25 has an oblong planar shape that is slightly longer in the vertical direction of FIG. 1 and substantially middle parts of both arcuate sections 26 are substantially straight lines parallel to each other. The filling recess 25 is displaced slightly laterally to the left of the center of the bottom surface 23 of the fitting recess 22 so as to conform to the position of the projecting area of the tabs 13 of the male terminal 12 which are displaced slightly laterally in the bottom surface 23 of the fitting recess 22, as described above.

The tabs 13 of the male terminals 12 project up from the bottom surface 25A of the filling recess 25, and conical or pyramidal projecting portions 27 are formed at positions of the bottom surface 25A where the respective tabs 13 project. Further, bite-in grooves 14 are formed in the opposite surfaces of the respective projecting tabs 13 at their base ends.

On the other hand, a boundary stepped surface 30 is formed around the filling recess 25 in the bottom surface 23 of the fitting recess 22 and is slightly lower than the bottom surface 23 while leaving an outer peripheral portion of the bottom surface 23 having a substantially equal width. The remaining annular bottom surface 23 serves as a connecting surface that is contacted by the front surface of the mating female connector.

The planar shape of the outer peripheral edge of the boundary stepped surface 30 has a substantially circular shape one size larger than the filling recess 25, and only the left edge thereof is substantially straight in conformity with the corresponding left side of the filling recess 25. There is a margin between the opposite right side of the filling recess 25 and the corresponding right side wall of the fitting recess 22 due to the slight lateral displacement of the filling recess 25 to the left, as described above. Thus, the right edge of the boundary stepped surface 30 bulges out from the right edge of the fitting recess 25 while the right edge thereof remains substantially circular.

The boundary stepped surface 30 forms a substantially annular area between the outer periphery of the filling recess 25 and the outer periphery of the boundary stepped surface 30. A lengthwise part of this annular area corresponding to the outer side of the right side of the filling recess 25 is wider than the other area and defines a visual confirmation area 32.

A detecting stepped surface 34 is formed at least partly around the outer and upper peripheral edge of the filling recess 25 and is slightly lower than the boundary stepped surface 30. The outer peripheral edge of the detecting stepped surface 34 has a substantially oblong planar shape that is slightly larger than the filling recess 25, and the outer peripheral edge of the detecting stepped surface 34 is in an intermediate position between the outer peripheral edge of the filling recess 25 and that of the boundary stepped surface 30.

As described above, the sealant "s" is filled partly into the filling recess 25 so that the upper surface of the sealant "s" is between the detecting stepped surface 34 and the boundary stepped surface 30. With this filled height, the mating female connector can be connected to a proper position for contacting the remaining annular bottom surface 23 of the fitting recess 22 and projecting parts of the tabs 13 are sealed securely.

The wider visual confirmation area 32 is at a lengthwise middle part. The detecting stepped surface 34 and the boundary stepped surface 30 are formed at the inner and outer sides of the wider visual confirmation area 32 and have about half the width of the visual confirmation area 32.

The insert molded connector described above is set in a filling apparatus with the fitting recess 22 faced up. A specified amount of sealant "s" is filled into the filling recess 25 through an injection nozzle of a dispenser (not shown). The color of the filled sealant "s" differs from that of the main body 10. The connector is brought to a testing process after the sealant "s" is solidified.

In the testing process, the visual confirmation area 32 in the fitting recess 22 of the connector is seen from above. If the filled amount of the sealant "s" is proper, as shown in FIG. 4, the sealant "s" covers the detecting stepped surface 34, but the boundary stepped surface 30 at the outer side is exposed in the visual confirmation area 32, as shown in FIG. 3. The filled amount can be judged to be proper by detecting this state.

Figure 5:
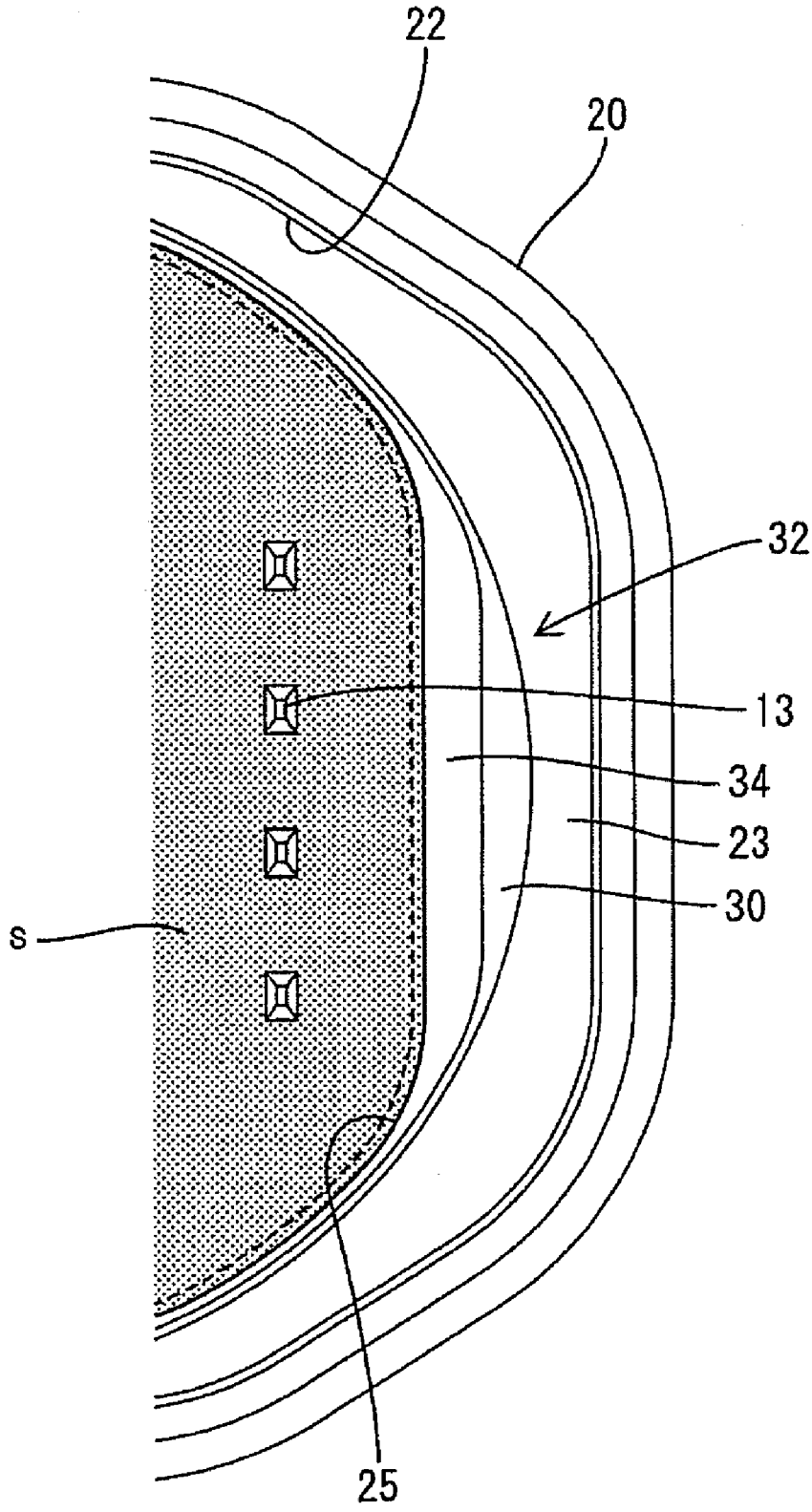
FIG. 5 is a plan view showing a visual confirmation area when the filled amount of sealant is too little.
Figure 6:
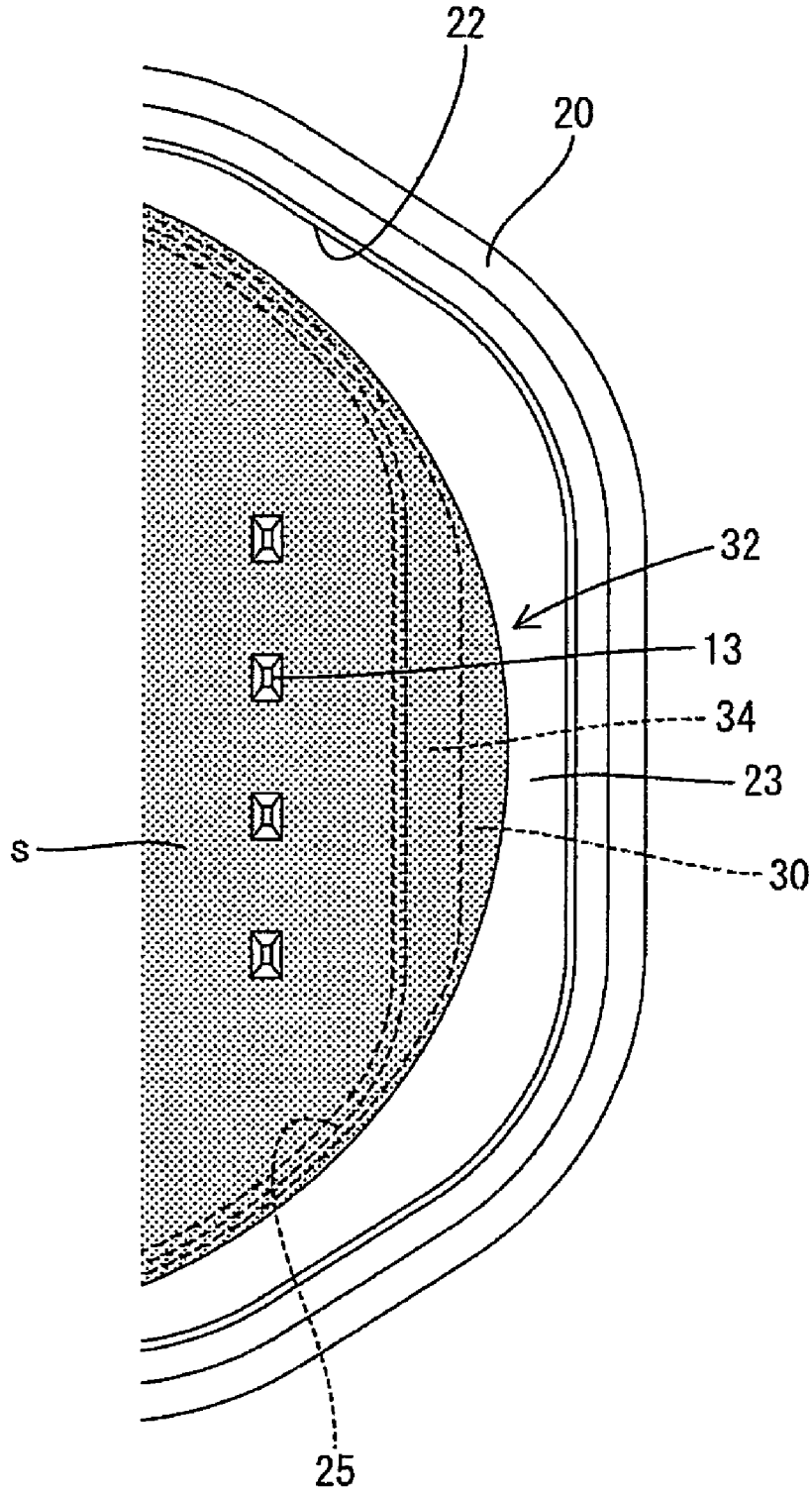
FIG. 6 is a plan view showing the visual confirmation area when the filled amount of sealant is excessive.

If the filled amount is too little, an upper-surface position h1 of the sealant "s" is below the detecting stepped surface 34, as shown in FIG. 4. Thus, the detecting stepped surface 34 and the boundary stepped surface 30 at the inner and outer sides both are seen to be exposed when the visual confirmation area 32 is viewed from above, as shown in FIG. 5. Conversely, if the filled amount is excessive, an upper-surface position h2 of the sealant "s" is above the boundary stepped surface 30, as shown in FIG. 4, and both the detecting stepped surface 34 and the boundary stepped surface 30 are covered by the sealant "s" and cannot be seen, as shown in FIG. 6. In these cases, sealing is judged to be improper.

As described above, the filled amount of the sealant "s" is substantially proper if the detecting stepped surface 34 cannot be seen from above in the visual confirmation area 32, but the boundary stepped surface 30 at its outer side can be seen (FIG. 3). The filled amount of the sealant it is too little if both the detecting stepped surface 34 and the boundary stepped surface 30 can be seen (FIG. 5) and is excessive if the detecting stepped surface 34 and the boundary stepped surface 30 are covered by the sealant "s" and cannot be seen (FIG. 6).

Both the detecting stepped surface 34 and the boundary stepped surface 30 are wide in the visual confirmation area 32. Thus, the three states described above can be judged precisely to determine whether the filled amount of the sealant "s" is proper. The detecting stepped surface 34 and the boundary stepped surface 30 are wide only in the wide visual confirmation area 32, which is provided only partly by displacing the filling recess 25 and causing the planar shape of the boundary stepped surface 30 to differ from that of the filling recess 25. Therefore, the enlargement of the entire connector can be avoided.

Since the boundary stepped surface 30 is slightly lower than the connecting surface that is contacted by the mating female connector. Thus, this connector can be connected properly with the mating female connector as long as the sealant "s" covers substantially just to the boundary stepped surface 30.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

Although the boundary stepped surface is set to be lower than the bottom surface of the fitting recess that serves as a connecting surface with which the mating female connector comes into contact in the foregoing embodiment, the connecting surface itself may be used as a boundary stepped surface and such a boundary stepped surface is also embraced by the technical scope of the present invention.

The planar shape of the fitting recess and that of the outer peripheral edge of the boundary stepped surface differ in the foregoing embodiment. In addition, the fitting recess and the boundary stepped surface may be formed at eccentric positions so that their centers deviate from each other or may be formed by causing the planar shapes thereof to differ and locating them at the eccentric positions.

The invention is applicable not only to intermediate connectors to be installed in transmission cases, but also to other intermediate connectors used for other purposes or to a wide range of connectors in general (e.g. for other electrical devices or appliances such as junction boxes, fuse and/or relay boxes, instrument panels or the like) in which terminal fittings are at least partly embedded in a connector main body by insert molding and sealed by filling sealant.

It should be understood that the invention is applicable to a situation where the filled amount of sealant "s" can be confirmed visually by an operator or by detection by means of a detecting device, such as a (CCD-) camera or the like having an image analyzing capability, of the sealant "s" filled into the filling recess 25 into the visual detecting surface 32.

What is claimed is:

1. A connector, comprising:

a main body made of synthetic resin and formed with a fitting recess having an open front end for receiving a mating connector along a mating direction, the fitting recess having a bottom surface facing substantially towards the front end;

a filling recess recessed in part of the bottom surface of the fitting recess and having a bottom wall;

terminal fittings mounting in the bottom wall, the terminal fittings projecting in the mating direction through the filling recess and into the fitting recess;

a boundary diverging surface facing substantially towards the front end, the boundary diverging surface being formed at least partly around the filling recess;

a detecting diverging surface facing substantially towards the front end, the detecting diverging surface being formed at least partly around an outer periphery of the filling recess and being between the bottom wall of the filling recess and the boundary diverging surface;

a sealant filled at least partly into the filling recess and around portions of the terminal fittings projecting through the filling recess; and a visual confirmation area formed along one transverse side of the filling recess, the visual confirmation area including portions of the boundary diverging surface and the detecting diverging surface having widths measured transverse to the mating direction that exceed widths of the boundary diverging surface and the detecting diverging surface at all other locations around the filling recess.

2. The connector of claim 1, wherein the visual confirmation area is formed by causing the planar shapes of the filling recess and the boundary diverging surface to differ from each other.

3. The connector of claim 1, wherein the visual confirmation area is formed by locating the filling recess at an eccentric position so that the center thereof is deviated from the center of the boundary diverging surface.

4. The connector of claim 1, wherein the terminal fittings project up from the bottom surface of the filling recess, and projecting portions are formed at positions of the bottom surface where the terminal fittings project.

5. The connector of claim 1, wherein bite-in grooves are formed on substantially opposite surfaces of the respective terminal fittings.

6. The connector of claim 1, wherein terminal fittings are at least partly embedded in at least one primary molded piece by insert molding while penetrating it and secondary insert molding is applied to form at least one secondary molded piece with the primary molded pieces including the terminal fittings as an insert for forming the main body.

7. The connector of claim 1, wherein the detecting diverging surface has width in a range of about one third to about two thirds of a width between the peripheral edge of the fitting recess and that of the boundary diverging surface in at least part of the visual confirmation area.

8. A connector, comprising:

a main body formed with a substantially tubular wall having an open front end to define a fitting recess for receiving a mating connector along a mating direction, the tubular wall including opposite first and second side sections, the fitting recess having a bottom surface facing substantially towards the front end;

a filling recess recessed in part of the bottom surface of the fitting recess and having a bottom wall facing the open front end, the filling recess being nonsymmetrically disposed with respect to the tubular side wall so that the filling recess is offset closer to the first side section of the tubular wall than the second side section thereof;

a boundary diverging surface formed at least partly around the filling recess at a position between the bottom surface of the fitting recess and the bottom wall of the filling recess, a width of the boundary diverging surface in directions orthogonal to the mating direction being greater at portions of the boundary diverging surface closer to the second side section of the tubular wall than at other sections of the boundary diverging surface; and a detecting diverging surface formed at least partly around the filling recess at a position between the boundary diverging surface and the bottom wall of the filling recess, a width of the detecting diverging surface measured substantially orthogonal to the mating direction being greater at portions of the detecting diverging surface closer to the second side section than at other sections of the detecting diverging surface, whereby portions of the boundary diverging surface and the detecting diverging surface closer to the second side section define a visual confirmation area for gauging depth positions in the filling recess.

9. The connector of claim 8, further comprising terminal fittings mounted in the bottom wall, the terminal fittings projecting substantially along the mating direction through the filling recess and into the fitting recess.

10. The connector of claim 9, further comprising a sealant in the filling recess and surrounding portions of the terminal fittings projecting through the filling recess, whereby the visual confirmation area enables detection of a level of the sealant relative to the boundary diverging surface and the detecting diverging surface while maintaining a small cross sectional size for the connector.

* * * * *